United States Patent [19]

Besenbruch

[11] 4,103,461

[45] Aug. 1, 1978

[54] GRINDING TOOLS FOR CYLINDERS

[75] Inventor: Alex Besenbruch, Isabela, P.R.

[73] Assignee: Besenbruch-Hofmann, Inc., Lindenhurst, N.Y.

[21] Appl. No.: 820,549

[22] Filed: Aug. 1, 1977

[51] Int. Cl.[2] ..... B24B 33/08

[52] U.S. Cl. ..... 51/352; 51/353

[58] Field of Search ..... 51/331, 332, 352, 353, 51/354, 341

[56] References Cited

U.S. PATENT DOCUMENTS

| | | | |
|---|---|---|---|
| 2,736,146 | 2/1956 | Brooks | 51/341 |
| 3,334,453 | 8/1967 | Von Tersch | 51/353 |
| 3,381,419 | 5/1968 | Johnson | 51/353 X |
| 3,713,256 | 1/1973 | Besenbruch | 51/353 |

*Primary Examiner*—N. P. Godici

*Attorney, Agent, or Firm*—Edward H. Loveman

[57] ABSTRACT

A grinding tool for the inside of cylinder has a motor driven stem carrying a hub on which is a notched hub member detachably securing ends of three flexible legs. A shoe having a fixed grindstone is pivotally attached to each of the legs and is releasably held by a spring clip. A sleeve surrounds the hub member to help hold the legs in place. A nut secures the sleeve on the hub member. An annular flange is loosely fitted on the hub and is held by the nut to serve as a stationary hand grip while the remainder of the tool rotates.

9 Claims, 7 Drawing Figures

GRINDING TOOLS FOR CYLINDERS

This invention concerns an improved grinding tool, and more particularly concerns an improved grinding tool for grinding the internal surfaces of cylinders such as brake cylinders.

The present invention involves improvements over those described in my prior U. S. Pat. No. 3,713,256, issued Jan. 30, 1973. In the patent there is described a grinding tool having three stiff legs which are radially disposed around a hub. The legs are movable radially inwardly against bias of springs inside the hub. On top of the hub is a fixed flange which limits axial inward movement of the tool in a cylinder being ground.

While the above described grinding tool has been generally successful, it has been found desirable and necessary to incorporate a number of improvements which form the subject matter of the present invention.

In the improved grinding tool described herein, the tool has flexible legs carried by the hub. The flexibility of the legs make it possible to conform them to cylinders of various diameters, without the use of internal springs in the hub. Brake shoes attached to the legs are pivotally attached in a simplified quickly detachable manner. An annular flange is rotatably mounted on the stem of the tool. This flange can be grasped to for use in steadying the tool and for moving it axially. The annular flange remains stationary when grasped while the remainder of the tool rotates during a grinding operation. The tool in general has a simplified construction as compared with the prior structure, while at the same time providing improved grinding results.

It is therefore a principal object of the present invention to provide a grinding tool having a motor driven stem and hub carrying a plurality of fixed, flexible radial legs each having a removable pivoting shoe supporting a grindstone.

A further object of the present invention is to provide a grinding tool as described with a freely mounted annular flange to serve as a finger or hand grip to facilitate moving the tool axially of the cylinder.

Another object of the present invention is to provide a grinding tool as described with improved, simplified quick engagement and disengagement spring clips for the shoes carrying the grinding stones.

A further object of the present invention is to provide an improved grinding tool as described with a simplified structure so that it is easier and less costly to manufacture and has less working parts, while providing improved grinding performance.

These and other objects and many of the attendant advantages of this invention will be readily appreciated as the same becomes better understood by reference to the following detailed description when considered in connection with the accompanying drawings in which.

Figure 1:
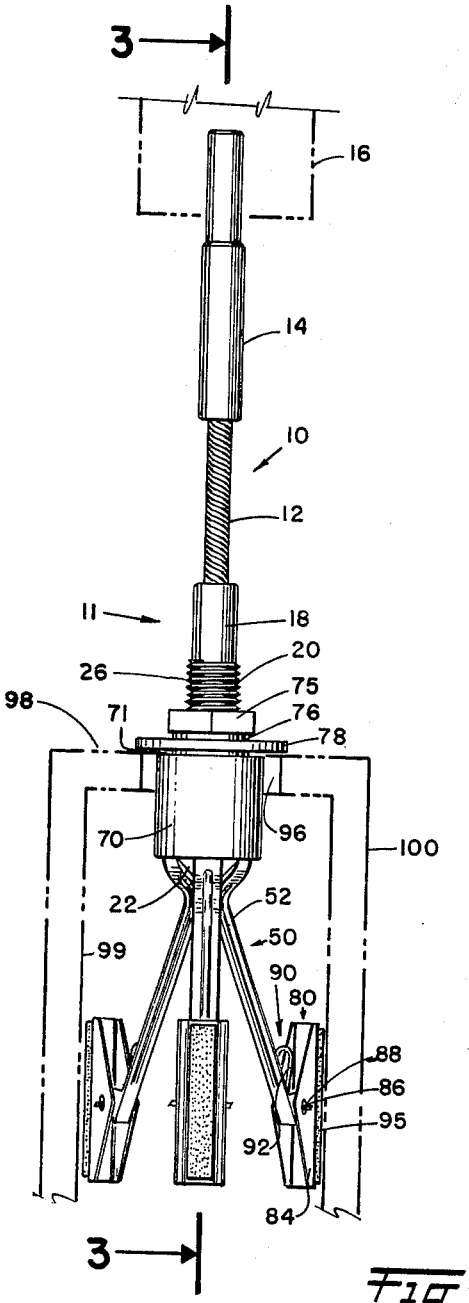
FIG. 1 is a side elevational view of the grinding tool embodying the invention.
Figure 3A:
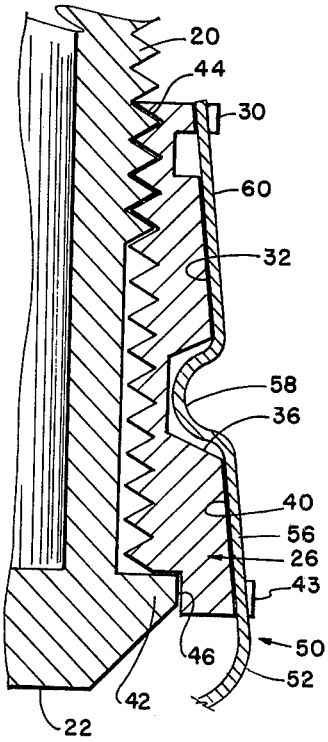
FIG. 3A is an enlarged fragmentary sectional view similar to a portion of FIG. 3.
Figure 2:
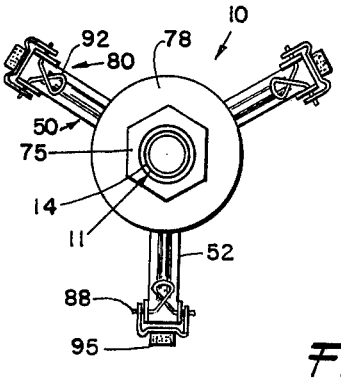
FIG. 2 is a top plan view of the grinding tool.
Figure 3:
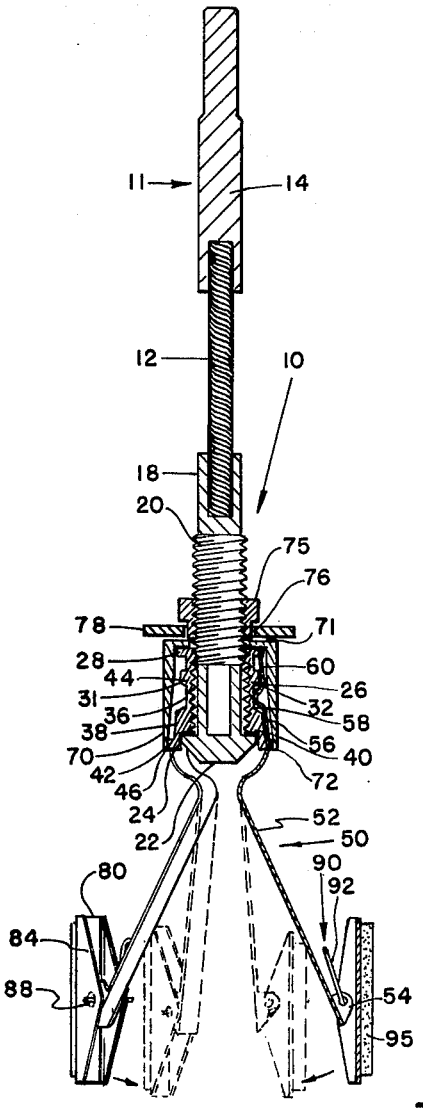
FIG. 3 is a longitudinal central sectional view taken along line 3—3 of FIG. 1.

Referring now to the drawings wherein like reference characters designate like or corresponding parts throughout, there is illustrated in FIGS. 1, 2, and 3, a grinding tool, generally designated by reference numeral 10 which has an axial stem assembly 11 including a flexible shaft 12. At one end of the shaft is a fitting 14 which may be secured in a chuck 16 of a driving motor (not shown). At the other end of shaft 12 is secured one end of a cylindrical hub 18 having a threaded intermediate section 20 and terminating in a head 22 formed with an annular rim 24.

Figure 6:
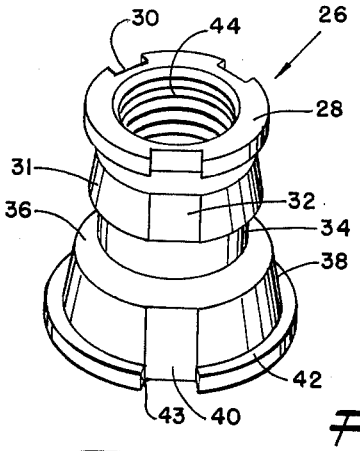
FIG. 6 is an enlarged perspective view of a hub member which supports the legs in the hub.

Threaded onto the section 20 is an internally threaded hub member or sleeve 26, best shown in FIGS. 3 and 6. The hub 26 is formed with an upper annular rim 28 in which is cut three notches 30 each equally spaced around the rim 28. Below the rim 28 is an integral conical body portion 31 formed with three lands 32 respectively aligned with one of the notches 30 and of equal width thereof. Below the body portion 31 is a narrow body portion 34 defining an annular recess 36. Below the body portion 34 is a conical sleeve portion 38 having three further lands 40 each aligned with one of the notches 30 and one of the lands 32. At the bottom of the sleeve portion 38 is an annular rim 42 defining notches 43 at the ends of the lands 40. The hub member 26 is formed with an internally threaded bore 44 for threading the member 26 on the threaded portion 20 of the hub 18. At the bottom of the bore 44 is an enlarged annular recess 46 which defines a shoulder which bears on the rim 42 of the member 26 as clearly shown in FIG. 3.

Engaged in the notches 30 and 43 are three flexible legs 50, shown in FIGS. 1–4. Each of the legs 50 has a straight flexible blade portion 52 terminating at its lower end in a pair of ears or tabs 54. The other end of the leg 50 has an upwardly or outwardly bent flat portion 56, then an inwardly curved portion 58 and finally a flat end portion 60 parallel to and coplanar with the leg portion 56.

It will be noted as shown in FIGS. 3, 3A, that the end portion 60 of each of the legs 50 fits inside one of the notches 30 and bears on the land 32. The curved portion 58 fits inside the recess 36 just below the land 32. The flat portion 56 of each leg 50 bears against the land 40 and is engaged in the notch 43. The leg portions 56 and 60 fit snugly inside the notches 30 and 43 and are held in place by a snug fitting sleeve 70 which has an internal annular recess 72 which receives and bears on the rim 42 of the body 26. At the upper end of the sleeve 70 is a flat circular top plate 71 formed with a central hole through which the hub 26 extends axially. Bearing on the top plate 71 is a nut 75 screwed tightly on the hub 26. The nut 75 has an annular recess 76 at the bottom which is axially wider than an annular washer or flange 78 which fits loosely around the hub 18 over the sleeve 70. The flange 78 may be grasped manually and held stationary while the remainder of the tool including the stem assembly 11, hub member 26, sleeve 70 and legs 50 rotate.

Figure 5:
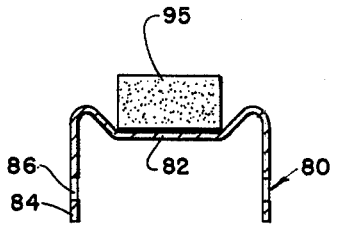
FIG. 5 is an enlarged cross sectional view taken along line 5—5 of FIG. 4.
Figure 4:
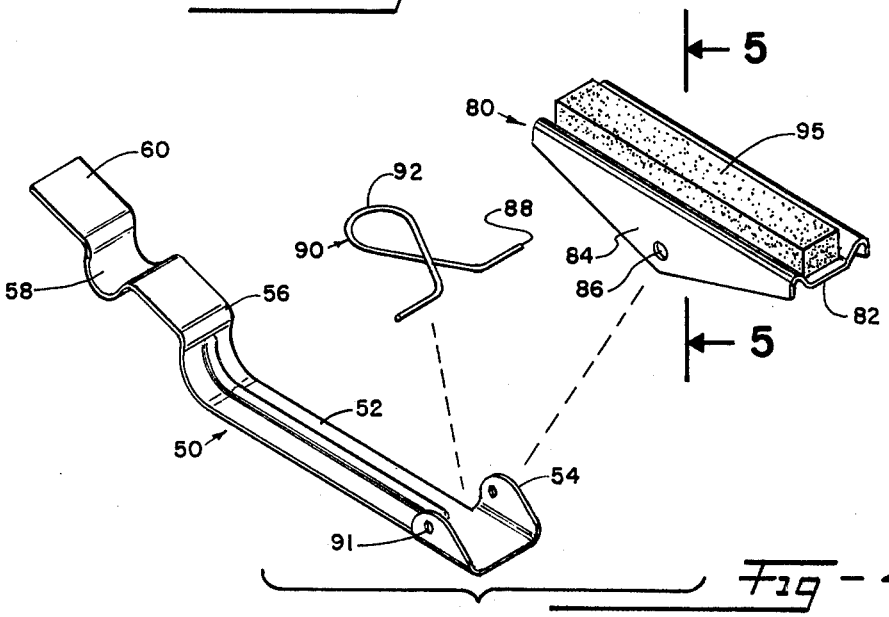
FIG. 4 is an exploded perspective view of parts of a leg assembly of the tool.

A grinding shoe 80 is pivotally mounted on one of the legs 50. The shoes 80 are channel shaped members each having a back 82 recessed between trapezoidal sides 84; see FIG. 5. Each of the sides 84 has a hole or slot 86 which receives outwardly turned end 88 of a crossed or twisted spring clip 90; see FIG. 4. The spring clip 90 fits within the ears 54 and each of the outwardly turned ends 88 extends through a hole 91 in the ear 54 and then through the hole 86 in the side 84 of the shoe 80. By pressing the sides of the loop 92 of the spring clip 90, the ends 88 may be retracted from the ears 54 for releasing the shoe 80 from the leg 50. Secured on the back 82 of each shoe 80 is a flat, rectangular grinding stone 95.

In operation of the grinding tool 10, the legs 50 may be compressed radially inward manually as indicated by dotted lines in FIG. 3 and arrows A in FIG. 1 for fitting the tool 10 through a hole 96 in a top wall 98 of a cylinder 100 which is to be ground by the tool 10; see FIG. 1. When released the bent legs 50 spring radially outward to press the grindstones 95 against the inside wall 99 of the cylinder 100. The flange 78 may be grasped manually to advance and retract the tool 10 axially. When grinding is completed the tool 10 may be withdrawn from the cylinder 100 until the radially extended blade portions 52 of the legs 50 reach the hole 96. Then by pulling the tool 10 further out axially, the legs 50 will be compressed radially by the rim of the hole 96. The legs 50 will then pass through the hole 96 until the shoes 80 reach the top wall 98. By then, blade portions 52 will extend outwardly beyond the hole 96, far enough for them to be grasped and compressed manually to enable the compressed legs 50 and the retracted shoes 80 to pass through the hole 96.

It will be noted that the structure described has a lesser number of parts than those of the prior grinding tool described in my prior patent, mentioned above. The tool herein described is thus adjustable for grinding cylinders of various internal diameters. The interior of the cylinder is made accessible because of the expansion and retraction of the flexible, spring legs 50 supporting grinding shoes 82 and grinding stones 95. Any shoe is quickly removable by releasing spring clip 80 for replacement with a new shoe and grinding stone. The free annular flange 78 serves as a hand hold means for advancing and retracting the tool axially, and for inserting the tool inside the cylinder. The tool is light in weight, relatively inexpensive to manufacture, strong and durable in construction and completely reliable in operation.

It should be understood that the foregoing relates to only a preferred embodiment of the invention and that it is intended to cover all changes and modifications of the example of the invention herein chosen for the purposes of the disclosure, which do not constitute departures from the spirit and scope of the invention.

The invention claimed is:

1. A grinding tool for a hollow cylinder having an end wall formed with a central hole, and a cylindrical inner wall to be ground, comprising:

a stem assembly including a cylindrical hub at one end;

a hub member surrounding said hub;

a plurality of flexible legs each having one end engaged on said hub member and having blade portions extending radially outward of said hub member;

a sleeve surrounding said hub member to hold said legs clamped on said hub member; and flange means loosely fitting around said hub to be manually gripped and held stationary when said stem assembly, said legs, and said sleeve rotate.

2. A grinding tool as defined in claim 1, wherein said hub is externally threaded, and wherein said sleeve has a circular end wall, and further comprising a nut engaged on said hub bearing on said end wall to hold said sleeve in place.

3. A grinding tool as defined in claim 1, wherein said legs have apertured means at free ends thereof, and further comprising shoes carrying grinding stones pivotally mounted at said free ends of said legs; and spring clips engaged with said apertured means and releasably holding said grinding shoes on said legs.

4. A grinding tool as defined in claim 3, wherein said hub is externally threaded, and wherein said sleeve has a circular end wall, and further comprising a nut engaged on said hub bearing on said end wall to hold said sleeve in place.

5. A grinding tool as defined in claim 4, wherein said nut has an annular recess, said flange loosely fitting on said nut in said recess, so that said stem assembly, legs and sleeve can rotate while said flange is held stationary.

6. A grinding tool as defined in claim 5, wherein said legs have apertured means at free ends thereof, and further comprising shoes carrying grinding stones pivotally mounted at said free ends of said legs; and spring clips engaged with said apertured means and releasably holding said grinding shoes on said legs.

7. A grinding tool as defined in claim 6, further comprising:

a flexible shaft secured axially to said hub; and a fitting secured to said shaft for engagement by motor means to rotate said stem assembly.

8. A grinding tool as defined in claim 6, wherein said hub member is internally threaded and is screwed on said hub, said hub member having a plurality of angularly spaced notches, and said legs having end portions bent to engage in said notches while said blade portions extend radially outward of said hub member.

9. A grinding tool as defined in claim 8, wherein said blade portions of said legs are sufficiently flexible to permit the same to compress radially inward for insertion through said hole in said end wall of said cylinder, and to permit said legs to expand when released to press said shoes and grinding stones against said inner wall of said cylinder.

* * * * *